US005479757A

United States Patent [19]

Ogawa

[11] Patent Number: 5,479,757

[45] Date of Patent: Jan. 2, 1996

[54] LABEL SUPPLYING APPARATUS

[75] Inventor: Koji Ogawa, Tokyo, Japan

[73] Assignee: Newlong Machine Works, Ltd., Tokyo, Japan

[21] Appl. No.: 264,808

[22] Filed: Jun. 23, 1994

[30] Foreign Application Priority Data

Jan. 12, 1994 [JP] Japan ..... 6-013087

[51] Int. Cl.[6] ..... B65B 61/14

[52] U.S. Cl. ..... 53/135.1; 53/136.1; 156/556; 156/566

[58] Field of Search ..... 53/135.1, 135.2, 53/135.3, 136.1, 136.2, 415; 156/D12, D27, 571, 556, 566, 567, 568

[56] References Cited

U.S. PATENT DOCUMENTS

| | | | |
|---|---|---|---|
| 3,338,192 | 8/1967 | King | 53/136.1 |
| 3,439,470 | 4/1969 | Brinkmeier | 53/415 |
| 4,321,103 | 3/1982 | Lindstrom et al. | 156/566 |
| 5,169,489 | 12/1992 | Kalisiak et al. | 156/556 |
| 5,269,121 | 12/1993 | Draghetti | 156/566 |

FOREIGN PATENT DOCUMENTS 57-16823 4/1982 Japan .

*Primary Examiner*—John Sipos
*Assistant Examiner*—Ed Tolan
*Attorney, Agent, or Firm*—Lowe, Price, LeBlanc & Becker

[57] ABSTRACT

A label supplying apparatus for quickly supplying the labels such as the certificate labels to the mouths of the bags filled with the livestock feed and the like. A label stored in a label magazine is attracted under suction by a suction cup, and removed from the label magazine. The removed label is guided to drop into a label receiver, from which the label is delivered by mating scrum belts to a position where it is applied to the mouth of a bag that has been conveyed by a first guide-and-feed mechanism composed of a pair of V-belts. The mouth of the bag and the label are then conveyed by a second guide-and-feed mechanism composed of a pair of V-belts to a sewing machine, which then stitches the mouth of the bag and the label to each other.

7 Claims, 11 Drawing Sheets

LABEL SUPPLYING APPARATUS

BACKGROUND OF THE INVENTION

1. Field of the Invention

The present invention relates to a label supplying apparatus for supplying a label such as a certificate label or the like to the mouth of a bag which is filled up with a material such as a livestock feed or the like.

2. Description of the Relevant Art

One conventional label supplying apparatus for supplying a bag which is filled up with a compound livestock feed with a certificate label that indicates the name of the fodder, the ratio of the mixed ingredients thereof, and other information is known from Japanese laid-open utility model publication No. 57-16823.

The label supplying apparatus disclosed in this document includes a storage box for storing certificate labels, a support arm disposed in confronting relationship to an access opening of the storage box and having a holder with a solid adhesive filled in its distal end, a takeout device for actuating the support arm for swinging movement, a transfer device for transferring the support arm with a certificate label bonded to the holder to a predetermined position, peeling rollers for peeling the certificate label off the support arm, guide belts for guiding the mouth of a bag to a position near the peeling rollers, and another guide belt for delivering the peeled certificate label together with the bag to a sewing device.

When the takeout device angularly moves the support arm from a home position, the holder on the distal end of the support arm moves toward the access opening of the storage box, and the holder holds a certificate label in the storage box with the solid adhesive. The support arm then swings back to the home position to take out the certificate label, a piece at a time, from the storage box through the access opening thereof. Then, the transfer device translates the support arm to feed the certificate label bonded to the holder toward the peeling rollers. The certificate label is then peeled off the holder by the peeling rollers, and supplied to the mouth of a bag.

The label supplying apparatus is required to periodically supply the adhesive to its holder, since the holder takes out the certificate label from the storage box by causing a certificate label to be attached thereto with the aid of the solid adhesive. The transfer device transfers the removed certificate label toward the peeling rollers by means of a cylinder that translates the support arm from the home position toward a position near the peeling rollers. Therefore, the support arm is required to return to the home position after having fed the certificate label to the peeling rollers. More particularly, the piston of the cylinder has to make a reciprocating movement each time a certificate label is supplied to the mouth of a bag. Consequently, it takes a relatively long period of time to supply a certificate label to the mouth of a bag, or the number of certificate labels that can be supplied in a unit period of time is relatively small. Furthermore, the conventional label supplying apparatus is complex in overall structure, and the cost of manufacture thereof is high.

SUMMARY OF THE INVENTION

It is therefore an object of the present invention to provide a label supplying apparatus capable of quickly and reliably performing a series of operations comprising the operation to take out a label from a label magazine through a label drawing means and the operation to supply it to the mouth of a bag without use of an adhesive, in order to increase the processing speed of the label supplying apparatus.

Another object of the present invention is to provide a label supplying apparatus with a simplified construction for: easier maintenance and lower manufacturing cost.

A label supplying apparatus according to the present invention comprises a bag conveying means for conveying a bag in an upstanding posture, a table disposed above the bag conveying means, a first guide-and-feed means disposed between the bag conveying means and the table, for guiding and feeding the bag in the direction of conveyance of the bag while gripping the mouth of the bag, a label magazine disposed above the table, for storing a plurality of labels, a label takeout mechanism including a swing arm disposed near the takeout opening of the label magazine and a suction cup mounted on a distal end of the swing arm for selectively attracting and releasing one, at a time, of the labels stored in the label magazine, a bag detecting means disposed downwardly of the table, for detecting the bag conveyed by the bag conveying means, a first actuator means responsive to a detection signal from the bag detecting means, for angularly moving the swing arm of the label takeout mechanism, a label guide for downwardly guiding the label released from the suction cup of the label takeout mechanism, a label receiving means disposed below the label guide, for receiving the label guided downwardly by the label guide, a label detecting means for detecting the label received by the label receiving means, a first and a second label delivery means disposed between the label guide and the label receiving means to be movable toward and away from each other, for holding and transferring a label in a direction substantially perpendicular to the first guide-and-feed means, a second actuator means responsive to a detection signal from the label detecting means, for relatively moving the first and second label delivery means toward and away from each other, a second guide-and-feed means disposed upwardly of the bag conveying means and in series with the first guide-and-feed means, for guiding and feeding the mouth of the bag guided and fed by the first guide-and-feed means while holding the mouth of the bag and a label together, and label drawing means disposed near the first and second label delivery means, for bringing the label delivered by the first and second label delivery means toward the mouth of the bag guided and fed by the first guide-and-feed means in cooperation with the second guide-and-feed means.

When a bag filled up with a material is placed on the bag conveying means, the bag conveying means conveys the bag in its upstanding posture, and the first guide-and-feed means disposed below the table grips feeds the mouth of the bag toward the second guide-and-feed means.

When the bag conveyed by the bag conveying means is detected by the bag detecting means, the first actuator means disposed on a side of the label magazine actuates the arm of the label takeout mechanism to swing toward the access opening of the label magazine. The suction cup of the label takeout mechanism moves towards the access opening to attract one of the labels in the label magazine. The arm with the label attracted by the suction cup is then angularly moved to the label guide, thus taking out one piece of the label from the label magazine. When the suction cup is inactivated, the label drops along the label guide and is received by the label receiving means disposed below the label guide. When the label is detected by the label detecting means that is positioned near the label receiving means, the second actuator means moves the first label delivery means toward the second label delivery means. The label received by the label receiving means is then held between the first and second label delivery means, and delivered toward a region between the second guide-and-feed means and the label drawing means. The drawing means cooperates with the second guide-and-feed means in drawing the label toward the mouth of the bag, and the mouth of the bag and the label are gripped together for transfer by the second guide-and-feed means.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

Figure 1:
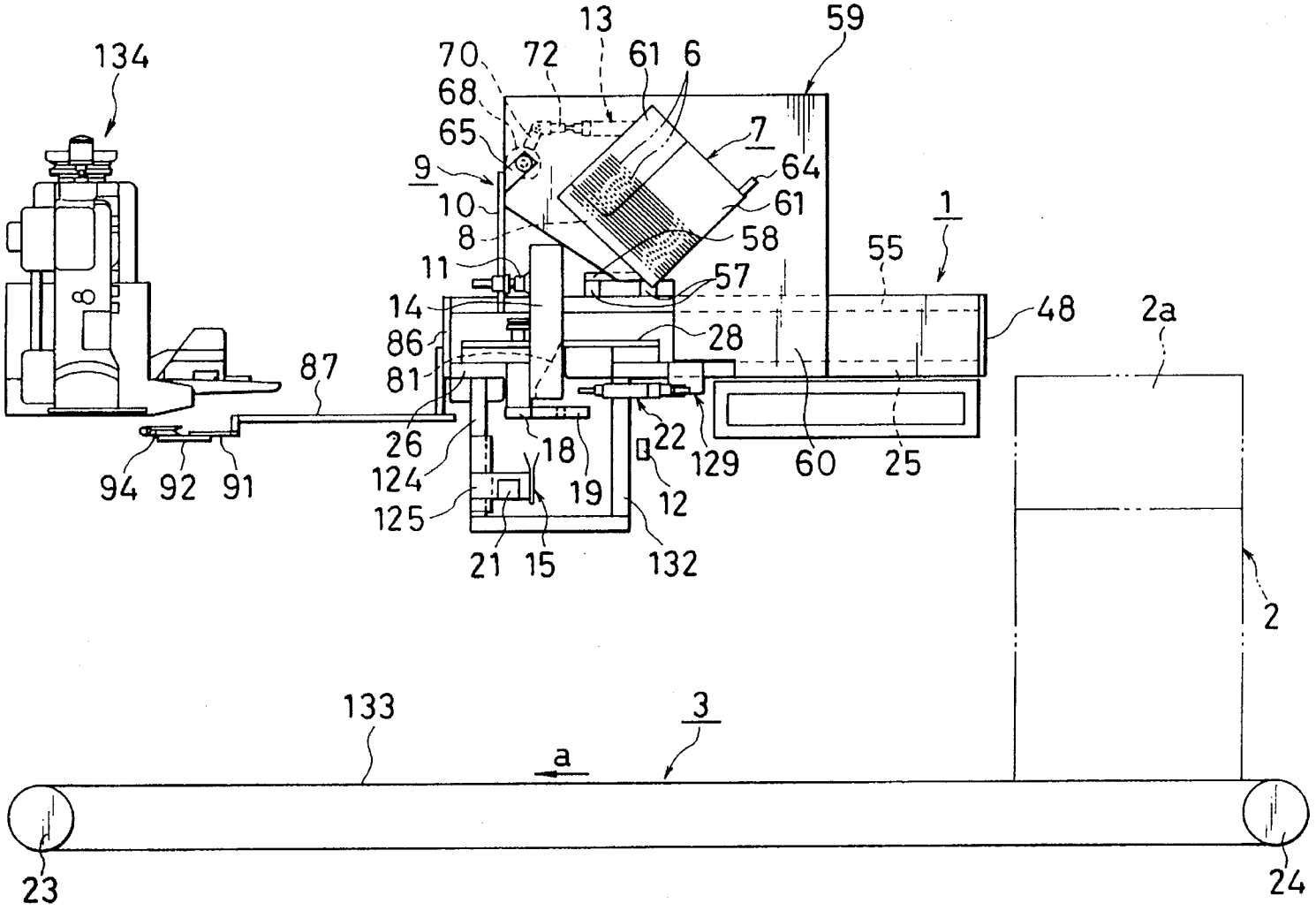
FIG. 1 is a front elevational view of a label supplying apparatus according to the present invention.

As shown in FIG. 1, a label supplying apparatus according to the present invention includes a horizontal table 1*a* and a belt conveyor 3 below the table 1 as a bag conveying means for conveying a bag 2. The belt conveyor 3 comprises a main roller 23, an auxiliary roller 24, and a conveyor belt 133 wound round these two rollers. The bag 2 is placed on the conveyor belt 133 and conveyed in the direction indicated by the arrow a in FIG. 1. A photoelectric switch 12 as a bag detector for detecting the bag 2 conveyed by the belt conveyor 3 is disposed underneath the table 1.

Figure 2:
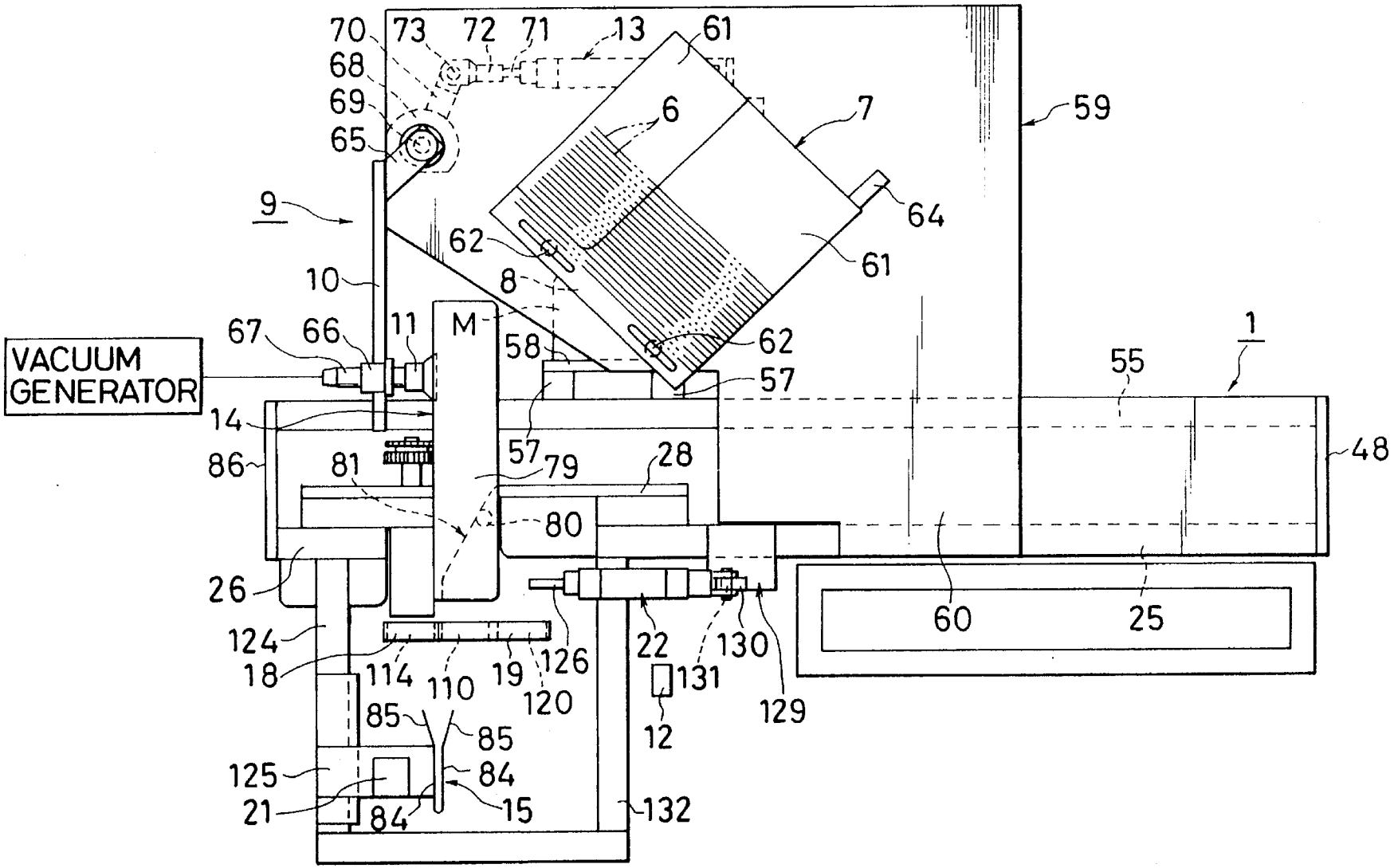
FIG. 2 is an enlarged fragmentary front elevational view showing the principal parts of the label supplying apparatus shown in FIG. 1.

As shown in FIGS. 1 and 2, a label magazine 7 for storing a number of labels 6 is disposed above the table 1. A label takeout mechanism 9 is disposed near the access opening 8 of the label magazine 7. The label takeout mechanism 9 comprises a swing arm 10 and a suction cup 11 mounted on the distal end of the arm 10 for attracting one piece at a time, of the labels 6 stored in the label magazine 7. An air cylinder 13, as a first actuator, is located on a side of the label magazine 7. The air cylinder 13 swings the arm 10 of the label takeout mechanism 9 in response to a detection signal from the photoelectric switch 12.

Between the access opening 8 of the label magazine 7 and the arm 10 of the label takeout mechanism 9, there is disposed a label guide 14 for guiding a label 6 released from the suction cup 11 in a downward direction. A label receiver 15 for receiving the label 6 guided downwardly by the label guide 14 is located below the label guide 14. In the vicinity of the label receiver 15, there is provided a photoelectric switch 21 as a label detector for detecting a label 6 received by the label receiver 15.

As shown in FIGS. 3 through 6, V-belts 4 and 5 confronting each other as a first guide-and-feed means is disposed between the belt conveyor 3 and the table 1. The V-belts 4 and 5 guide and feed a mouth 2*a* of a bag 2 while holding the same, in the longitudinal direction of the belt conveyor 3, i.e., in the direction indicated by the arrow a (see FIG. 1), at the same speed as the speed at which the belt conveyor 3 conveys the bag 2 thereon.

V-belts 16 and 17 confronting each other as a second guide-and-feed means is disposed above the belt conveyor 3. The V-belts 16 and 17 are disposed in series with the V-belts 4 and 5 for gripping and feeding the mouth 2*a* of a bag 2 and a label 6 together. The V-belts 4 and 5, as a first guide-and-feed means, and the V-belts 16 and 17, as a second guide-and-feed means, jointly form a linear guide-and-feed path for continuously guiding and feeding a bag mouth 2*a* while being held therebetween. The V-belt 5 and the V-belt 17 partially overlap each other, while the V-belt 4 and the V-belt 16 are separated from each other.

Between the label guide 14 and the label receiver 15, there is disposed a pair of scrum belts 18 and 19, as first and second label delivery means, for holding and transferring a label 6 in a direction substantially perpendicular to the guide and feed path by the V-belts 16 and 17, the scrum belts 18 and 19 being movable toward and away from each other.

Figure 4:
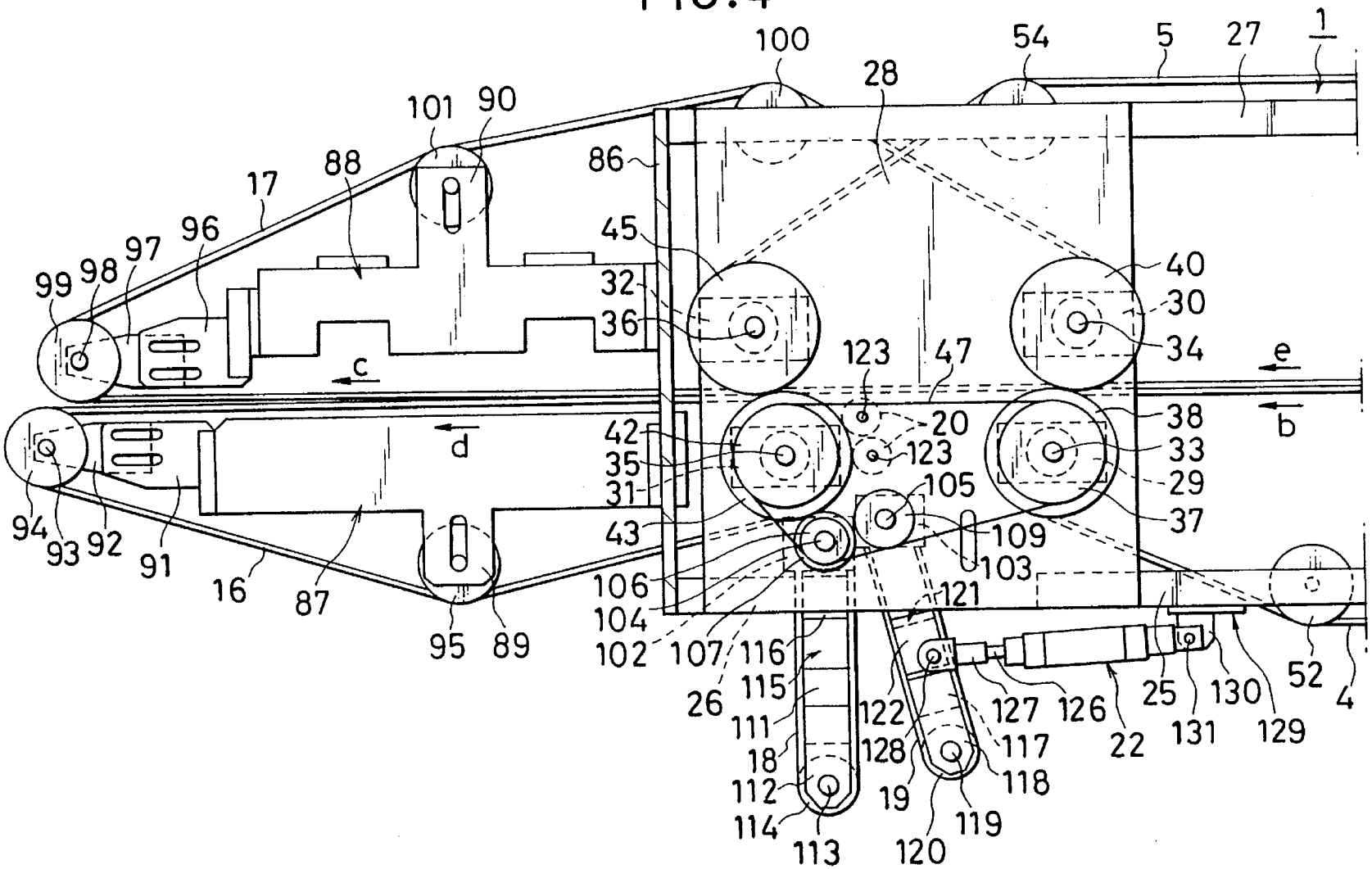
FIG. 4 is an enlarged fragmentary plan view showing the principal parts of the guide and feed mechanism and the label delivery mechanisms shown in FIG. 3.

As shown in FIG. 4, a pair of resilient rollers 20 is rotatably disposed in the vicinity of the scrum belts 18 and 19. The resilient rollers 20, as a label drawing means, are rotatable in contact with the V-belt 16 and cooperate therewith to draw a label 6 toward the mouth 2*a* of a bag 2. An air cylinder 22, as a second actuator, is disposed on a side of the table 1 for moving the scrum belt 19 toward the scrum belt 18 in response to a detection signal from the photoelectric switch 21.

Figure 3:
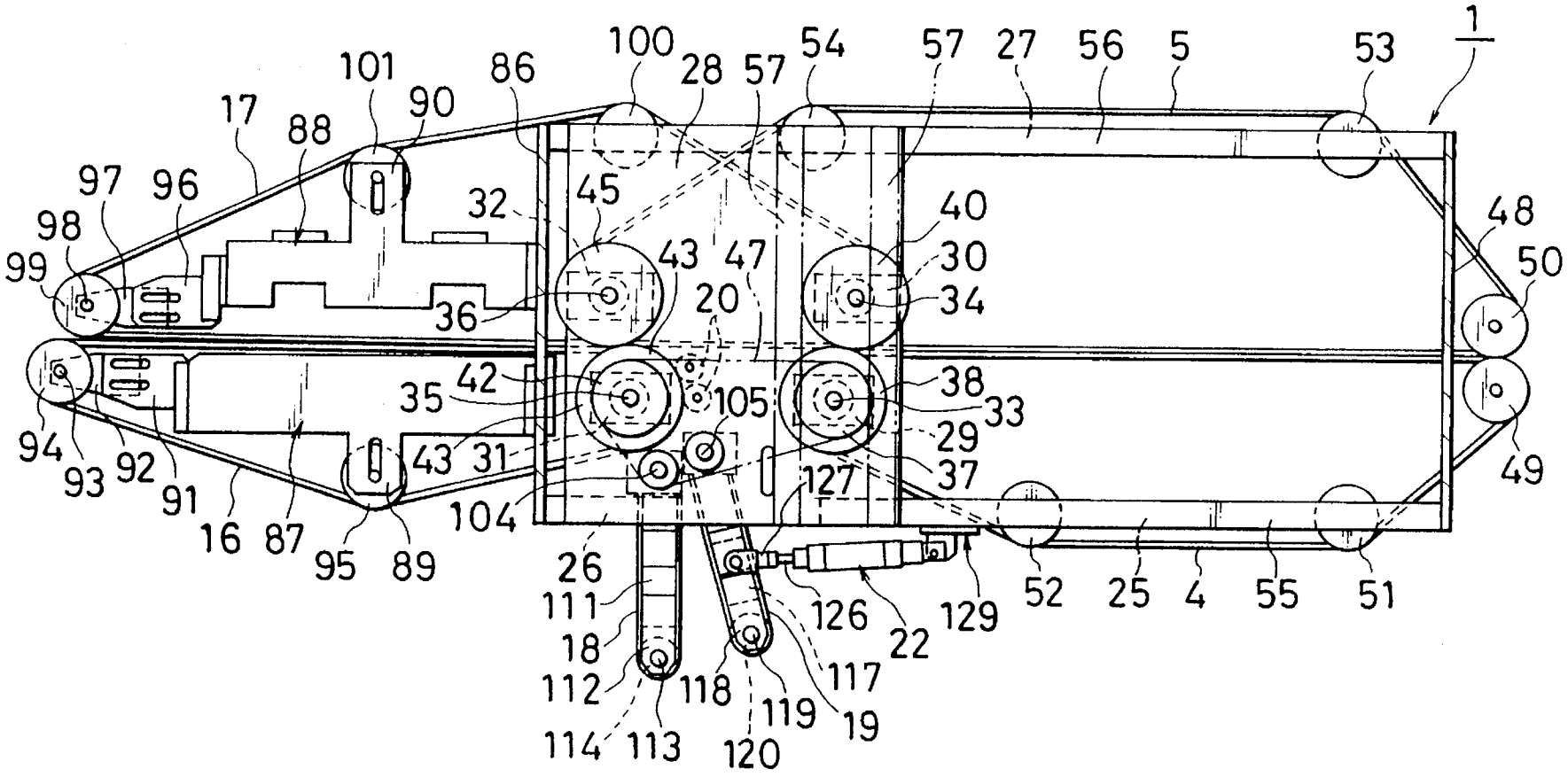
FIG. 3 is a plan view of a guide and feed mechanism and a label delivery mechanism.

As shown in FIGS. 1 and 2, the table 1 has longitudinal members 25, 26 and 27, and a bearing plate 28 is mounted on and disposed over these longitudinal members 25, 26 and 27. As shown in FIGS. 3 and 4, two bearings 29 and 30 are fixed to the lower surface of the bearing plate 28 near one end thereof, and two bearings 21 and 32 are fixed to the lower surface of the bearing plate 28 near the other end thereof. Vertical shafts 33, 34, 35 and 36 are rotatably supported by the bearings 29, 30, 31 and 32, respectively.

Figure 5:
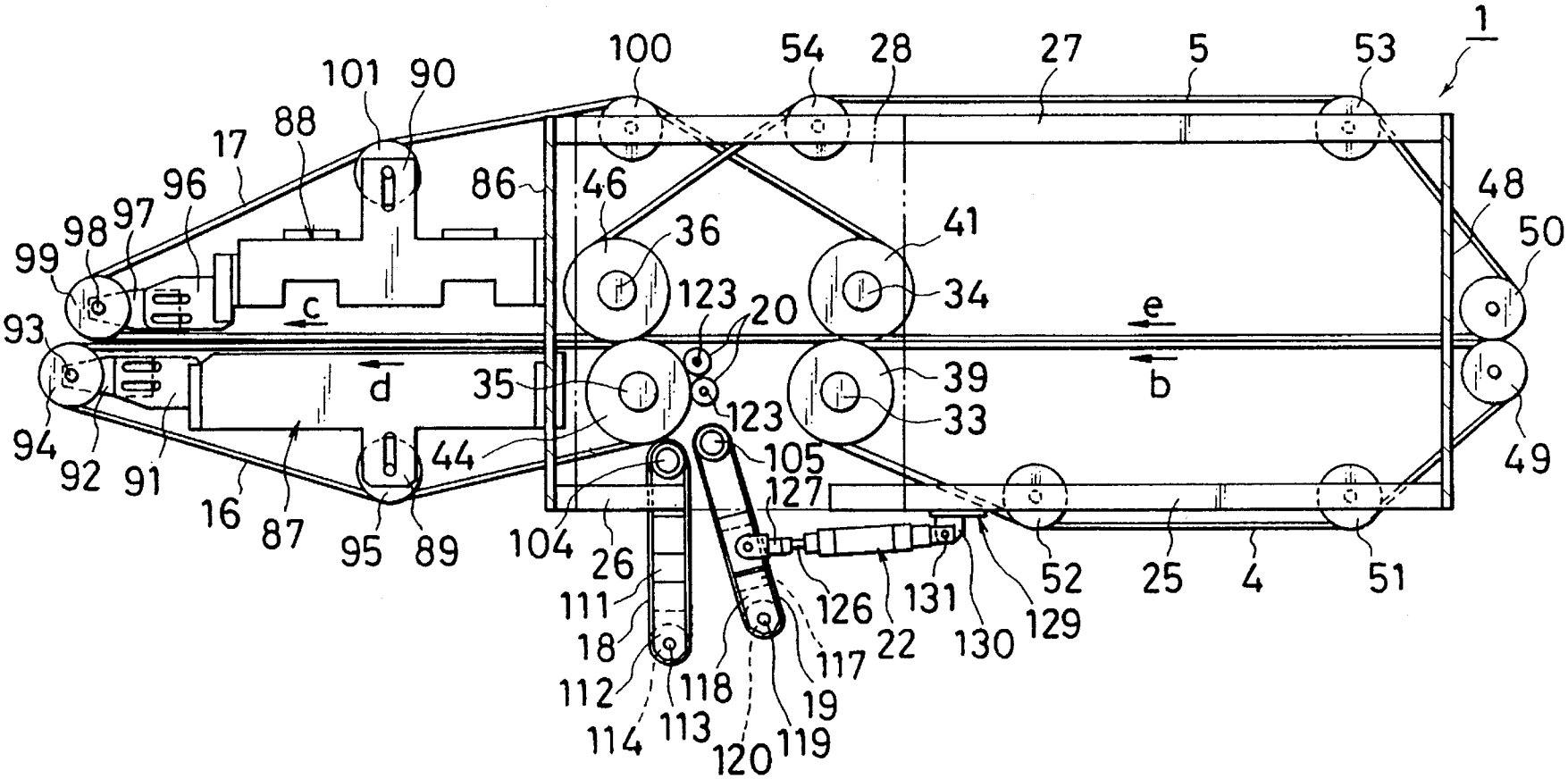
FIG. 5 is a plan view of a belt arrangement of the guide and feed mechanism and the label delivery mechanism.
Figure 6:
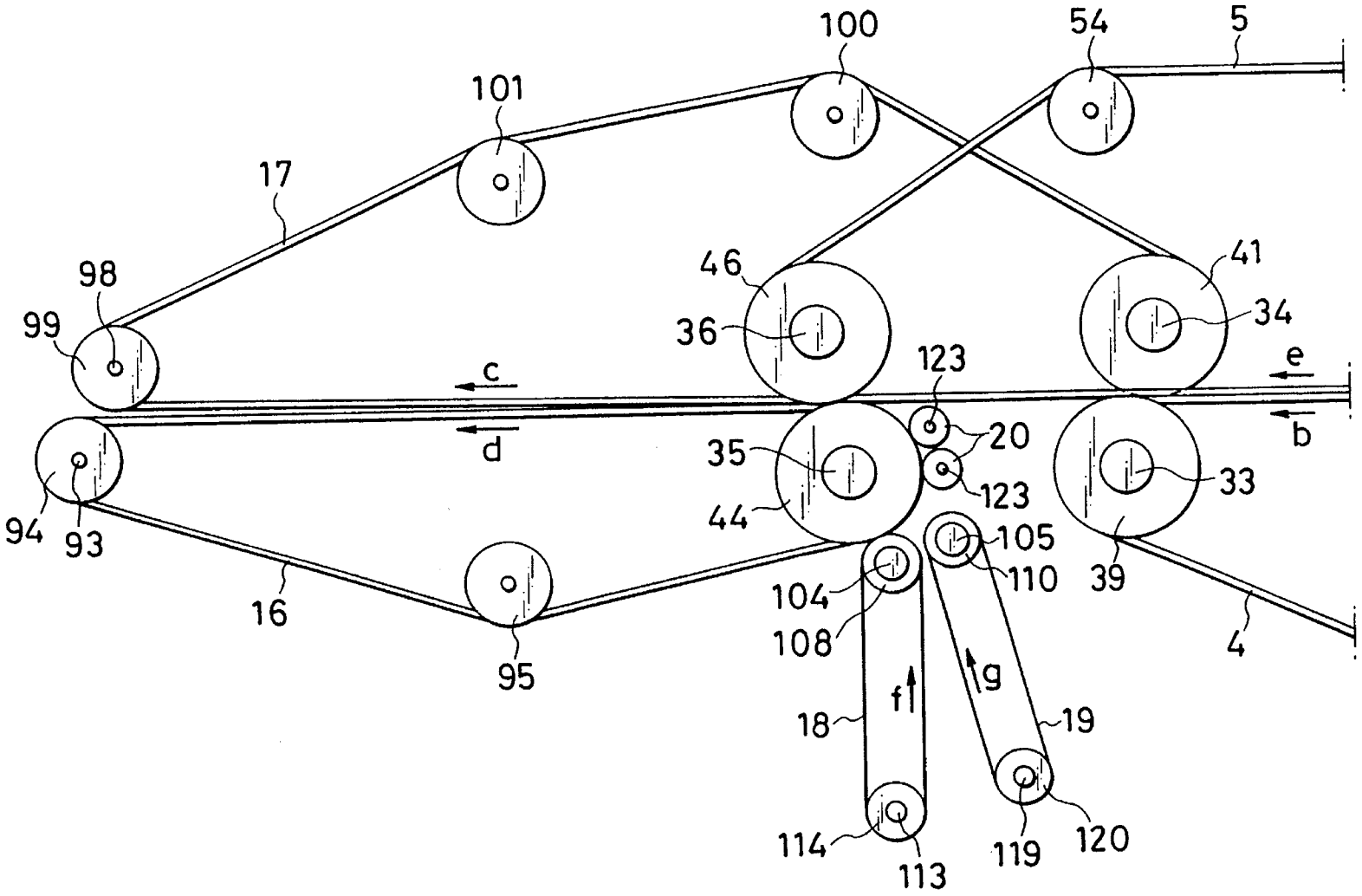
FIG. 6 an enlarged fragmentary plan view showing the principal parts of the mechanisms shown in FIG. 5.

As shown in FIGS. 3 and 4, a sprocket 37 is fixed to the upper end of the shaft 33, and a spur gear 38 is fixed to the shaft 33 under the sprocket 37. As shown in FIGS. 5 and 6, a pulley 39 is fixed to the lower end of the shaft 33. As shown in FIGS. 3 and 4, a spur gear 40 held in mesh with the spur gear 38 is fixed to the upper end of the shaft 34. As shown in FIGS. 5 and 6, a pulley 41 is fixed to the lower end of the shaft 34.. As shown in FIGS. 3 and 4, a sprocket 42 is fixed to the upper end of the shaft 35, and a spur gear 43 is fixed to the lower surface of the sprocket 42. As shown in FIGS. 5 and 6, a pulley 44 is fixed to the lower end of the shaft 35. As shown in FIGS. 3 and 4, a spur gear 45 held in mesh with the spur gear 43 is fixed to the upper end of the shaft 36. As shown in FIGS. 5 and 6, a pulley 46 is fixed to the lower end of the shaft 36.

As illustrated in FIGS. 3 and 5, tension pulleys 49 and 50 are rotatably disposed in outer and downward location near central region of a vertical end plate 48 of the table 1. A tension pulley 51 is rotatably disposed below and near one end of the longitudinal member 25, and a tension pulley 52 is rotatably disposed below and near the other end of the longitudinal member 25. A tension pulley 53 is rotatably disposed below and near one end of the longitudinal member 27, and a tension pulley 54 is rotatably disposed below and near the other end of the longitudinal member 27. As shown in FIG. 5, the V-belt 4 is wound around the outer peripheries of the pulley 39 and the tension pulleys 49, 51 and 52. The V-belt 5 is wound around the outer peripheries of the pulley 46 and the tension pulleys 50, 53 and 54.

As shown in FIGS. 2 and 3, a pair of parallel transverse members 57 is disposed on the longitudinal members 55 and 56, with a support plate 58 mounted on the upper surfaces of the transverse members 57. A motor M, as a drive means for rotating the shaft 33, is supported on the support plate 58.

As shown in FIGS. 1 and 2, a vertical base plate 59 is located on one side of the table 1 and extends upwardly. The base plate 59 has a leg 60 projecting downwardly from a lower edge thereof and fixed to outer edges of the respective longitudinal members 25 and 55 of the table 1.

Figure 7:
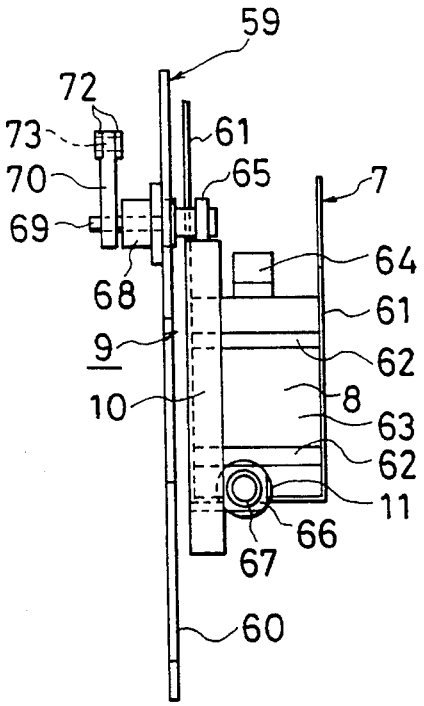
FIG. 7 is a side elevational view of a label magazine and a label takeout mechanism.
Figure 8:
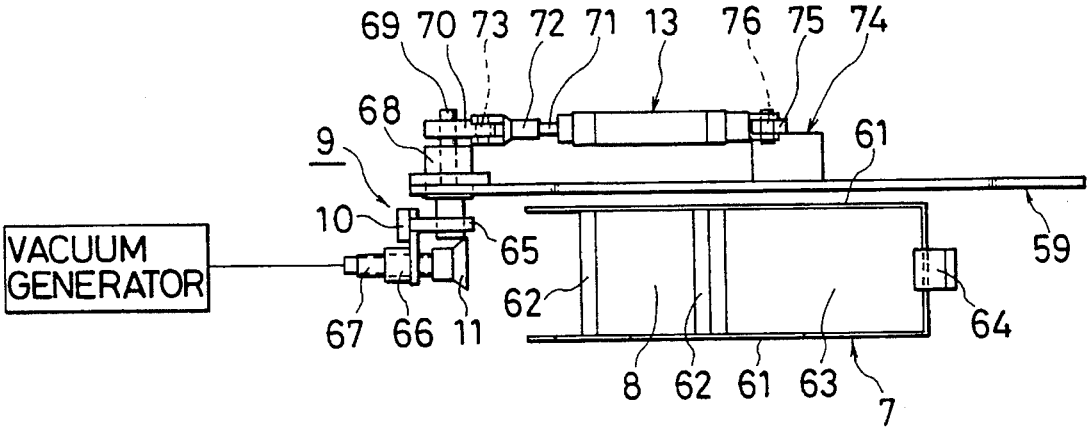
FIG. 8 is a plan view of the label magazine and the label takeout mechanism shown in FIG. 7.

The label magazine 7 for storing label 6 is installed on an outer surface of the base plate 59. The access opening 8 of the label magazine 7 opens obliquely downwardly. As shown in FIG. 7, a pair of parallel support bars 62, which is positioned in the access opening 8, extends between and are secured to vertical side walls 61 of the label magazine 7. As shown in FIG. 8, a photoelectric switch 64 for detecting labels 6 in the label magazine 7 is disposed near a central region of an upper end of a bottom wall 63 of the label magazine 7.

As shown in FIGS. 2, 7, and 8, a mounting plate 65 extending obliquely upwardly is fixed to the upper proximal end of the arm 10 of the label takeout mechanism 9. A pipe holder 66 is fixed to the arm 10 near its lower end, and a pipe 67 is secured to the pipe holder 66. The suction cup 11 is mounted on a distal end of the pipe 67, which is connected to a vacuum generator.

A bearing 68 is fixed to the base plate 59 near an edge thereof in the vicinity of its central region. A support shaft 69 is rotatably supported by the bearing 68. The support shaft 69 has an end fixed to a distal end of the attachment plate 65 and an opposite end fixed to an end of a lever 70.

As shown in FIGS. 2 and 8, the air cylinder 13 has a piston rod 71 secured at its distal end to a joint 72 which is coupled to the other end of the lever 70 by a coupling pin 73. As shown in FIG. 8, a bracket 74 is mounted on the base plate 59 near an upper edge thereof in the vicinity of its central region, the bracket 74 having an projecting portion 75. The air cylinder 13 has a proximal end connected to the projecting portion 75 by a coupling pin 76.

Figure 9:
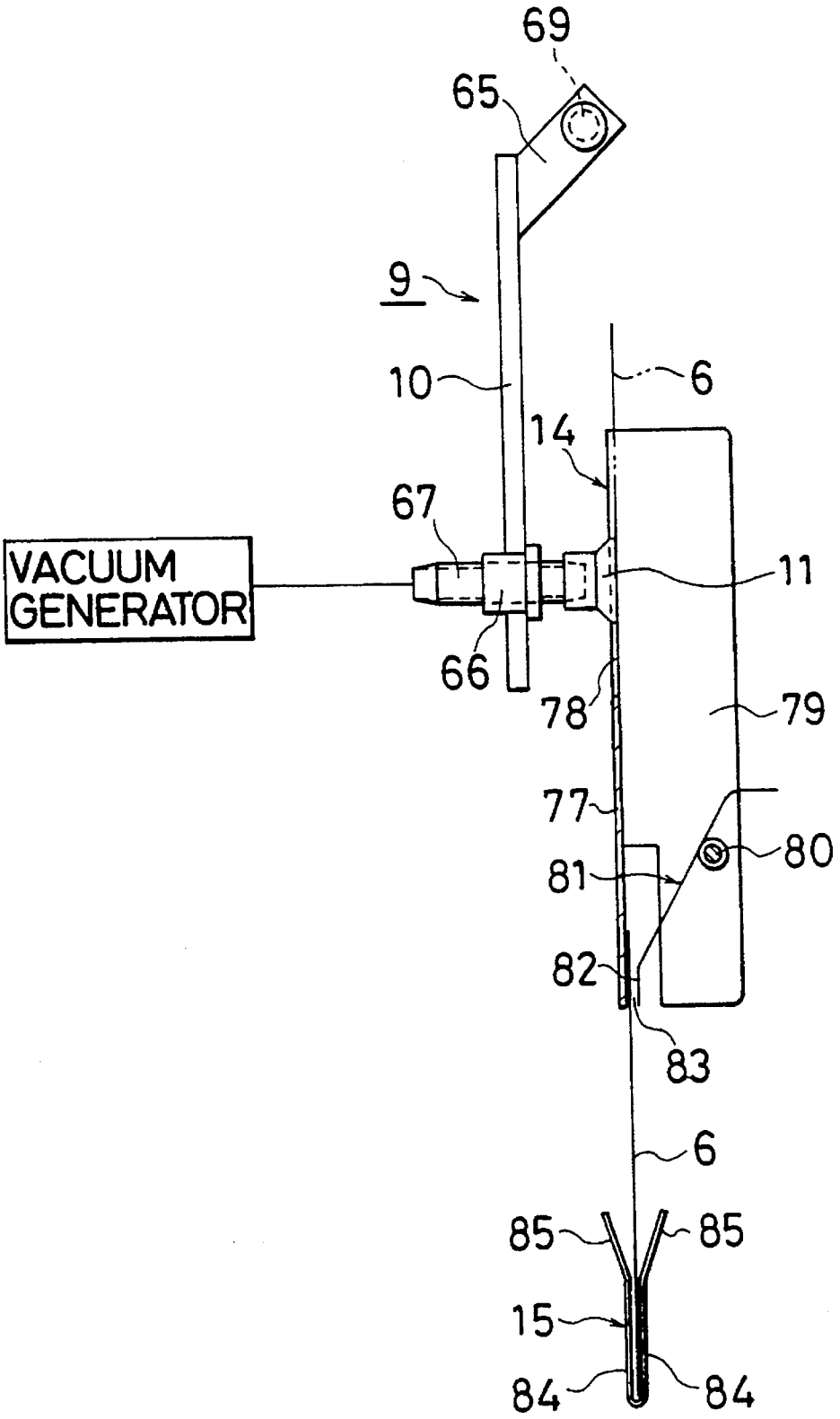
FIG. 9 is an enlarged cross-sectional view of a label guide and a label receiver.

As shown in FIG. 9, the label guide 14 includes a vertical wall 77 having a recess 78 defined therein near its upper end. A portion of the suction cup 11, which is attached to the distal end of arm 10 of the label takeout mechanism 9, enters the recess 78.

As shown in FIGS. 2 and 9, a horizontal support shaft 80 extends between and is supported on vertical side walls 79 of the label guide 14. A guide plate 81, which is supported on and secured to the support shaft 80, is inclined with respect to the vertical wall 77 for guiding a label 6 downwardly. The guide plate 81 has a downwardly extending portion 82 at its lower edge, which lies parallel to and is spaced from the vertical wall 77, thereby defining a gap 83 for passage of a label 6 therethrough. One of the side walls 79 of the label guide 14 is affixed to an outer surface of the longitudinal member 55 of the table 1.

As shown in FIGS. 2 and 9, the label receiver 15 has a pair of parallel spaced side walls 84 with respective guide portions 85 extending upwardly from the upper ends of the side walls 84 and spreading outwardly in the upward direction for receiving and guiding a label 6 as it falls from the label guide 14.

As shown in FIGS. 3 through 5, the table 1 has a vertical end plate 86 remote from the end plate 48, and a pair of parallel horizontal plates 87 and 88 is disposed outwardly of a central region of the end plate 86. The horizontal plates 87 and 88 have respective projecting portions 89 and 90 projecting away from each other from respective central regions thereof. Tension pulleys 95 and 101 are rotatably disposed under the projecting portions 89 and 90, respectively. A flat plate 91 is attached to a distal end of the horizontal plate 87, and a bracket 92 is secured to a lower surface of the flat plate 91. The bracket 92 has an upwardly projecting support pin 93 fixed to its distal end with a tension pulley 94 rotatably supported thereon. A flat plate 96 is attached to a distal end of the horizontal plate 88, and a bracket 97 is secured to a lower surface of the flat plate 96. The bracket 97 has an upwardly projecting pin 98 fixed to its distal end with a tension pulley 99 rotatably supported thereon. As shown in FIG. 5, a tension pulley 100 is rotatably mounted on the longitudinal member 27 near its end remote from the pulley 53.

The V-belt 16 is wound around the pulley 44 and the tension pulleys 94 and 95. The straight run of the V-belt 16 extending between the pulley 44 and the tension pulley 94 is aligned with the straight run of the V-belt 4 extending between the pulley 49 and the tension pulley 49.

The V-belt 17 is wound around the pulley 41 and the tension pulleys 99, 100 and 101. The straight run of the V-belt 17 extending between the pulley 41 and the tension pulley 99 is aligned with-the straight run of the V-belt 5 extending between the pulley 46 and the tension pulley 50.

As shown in FIGS. 3 and 4, bearings 102 and 103 are fixed to a lower surface of the bearing plate 28 in its central region near one edge thereof, and shafts 104 and 105 are rotatably supported by the respective bearings 102 and 103 along vertical direction. As shown in FIG. 4, a sprocket 106 is fixed to the upper end of the shaft 104, and a pinion 107 is fixed below the sprocket 106. As shown in FIG. 6, a pulley 108 is fixed to the lower end of the shaft 104. As shown in FIG. 4, an endless chain 47 is wound around the sprockets 37, 42 and 106.

As shown in FIG. 4, a pinion 109 is held in mesh with a pinion 107 fixed to the shaft 104, and is fixed to the upper end of the shaft 105. As shown in FIG. 6, a pulley 110 is fixed to the lower end of the shaft 105.

As shown in FIGS. 3 and 4, an arm 111 projects outwardly from a lower portion of the longitudinal member 26 near an end thereof, and a bracket 112 is mounted on an upper surface of the arm 111 at its distal end. A pulley 114 is rotatably supported on a downwardly projecting support pin 113 which is fixed to the distal end of the bracket 112.

As shown in FIG. 6, the scrum belt 18 as a first label drawing mechanism is wound around the outer peripheries of the pulleys 108 and 114.

As shown in FIG. 4, a bracket 115 is mounted on an upper surface of the arm 111 near its central region. A protrusion 116 formed on the bracket 115 is fixed to an outer surface of the longitudinal member 26 near the end thereof.

As illustrated in FIGS. 3 and 4, an arm 117 projecting outwardly of the table 1 is disposed alongside of the arm 111. A bracket 118 is mounted on an upper surface of the arm 117 near its distal end, and a pulley 120 is rotatably supported by a downwardly projecting support pin 119, which is fixed to the distal end of the bracket 118. The arm 117 has a proximal end angularly movably supported on the shaft 118 near its longitudinal middle thereof. As shown in FIG. 6, the serum belt 19 as a second label drawing means is wound around the pulleys 110 and 120.

As shown in FIG. 4, a bracket 121 is mounted on an upper surface of the arm 117. The bracket 121 has a protrusion 122 formed therewith. A joint 127 is fixed to the distal end of a piston rod 126 of the air cylinder 22 for angularly moving the arm 117. The protrusion 122 of the bracket 121 is coupled to the joint 127 with the coupling pin 128. A bracket 129 is mounted on an outer surface of the longitudinal member 25. A protrusion 130 formed with the bracket 129 is coupled by a coupling pin 131 to the proximal end of the air cylinder 22.

As shown in FIGS. 5 and 6, a pair of downwardly projecting support pins 123 is fixed to the bearing plate 28 in the vicinity of the pulley 44. The resilient rollers 20 are rotatably supported respectively on the support pins 123. The resilient rollers 20 are rotatable keeping in contact with the V-belt 16 wound around the pulley 44.

As shown in FIGS. 1 and 2, a bracket 125 is mounted on a lower end portion of a vertical member 124, which is mounted on and disposed downwardly of the table 1, the bracket 125 being parallel to the longitudinal member 26. The photoelectric switch 21 for detecting a label 6 as received by the label receiver 15 is mounted on the bracket 125 near its central region. One of the side walls 84 of the label receiver 15 is fixed to the distal end of the bracket 125.

As shown in FIGS. 1 and 2, the photoelectric switch 12 for detecting the mouth 2*a* of a bag, which has been conveyed by the belt conveyor 3, is mounted on a side of a vertical member 132 which is mounted on and disposed downwardly of the table 1.

As shown in FIG. 1, a sewing machine 134 is positioned above the main roller 23 of the belt conveyor 3, for sewing the mouth 2*a* of a bag 2 together with a label.

Now, operation of the label supplying apparatus will be described below.

When the main roller 23 of the belt conveyor 3 is rotated counterclockwise in FIG. 1 by a motor (not shown), the conveyor belt 133 moves in the direction indicated by the arrow a in FIG. 1. At the same time, the auxiliary roller 24 is rotated counterclockwise in FIG. 1 as the conveyor belt 133 moves.

Then, the motor M on the support plate 58 is energized to rotate the shaft 33 counterclockwise in FIG. 4 with respect to the bearing 29. When the shaft 33 is thus rotated, the sprocket 37, the spur gear 38, and the pulley 39 fixed to the shaft 33 rotate counterclockwise in FIGS. 4 and 5, The counterclockwise rotation of the pulley 39 causes the V-belt 4 to move in the direction indicated by the arrow b in FIG. 5. Upon the movement of the V-belt 4, the tension pulleys 49, 51 and 52 rotate counterclockwise in FIG. 5.

Since the spur gear 38 rotates counterclockwise in FIG. 4, the spur gear 40 meshing therewith is rotated clockwise in FIG. 4. The shaft 34 fixed to the spur gear 40 is then rotated clockwise in FIG. 4 with respect to the bearing 30, causing the pulley 41 secured to the shaft 34 to rotate clockwise in FIG. 5. The rotation of the pulley 41 causes the V-belt 17 to move in the direction indicated by the arrow c, thereby also causing the tension pulleys 99, 100 and 101 to rotate clockwise in FIG. 5.

The rotation of the sprocket 37 is transmitted by the chain 47 to the sprockets 42 and 106, which are then rotated counterclockwise in FIG. 4.

When the sprocket 42 is rotated counterclockwise, the shaft 35 rotates counterclockwise in FIG. 4 with respect to the bearing 31, enabling the spur gear 43 and the pulley 44 fixed to the shaft 35 to rotate counterclockwise in FIGS. 4 and 5. The rotation of the pulley 44 causes the V-belt 16 to move in the direction indicated by the arrow d in FIG. 5. The tension pulleys 94 and 95 are rotated counterclockwise in FIG. 5 by the V-belt 16.

Inasmuch as the spur gear 43 rotates counterclockwise in FIG. 4, the spur gear 45 meshing therewith is rotated clockwise in FIG. 4. The shaft fixed to the spur gear 45 is then rotated clockwise in FIG. 4, causing the pulley 48 secured to the shaft 38 to rotate clockwise in FIG. 5 with respect to the bearing 32. The rotation of the pulley 48 causes the V-belt 5 to move in the direction indicated by the arrow e, thereby also causing the tension pulleys 50, 53 and 54 to rotate clockwise in FIG. 5.

As the sprocket 108 rotates counterclockwise in FIG. 4, the shaft 104 fixed thereto is rotated counterclockwise in FIG. 4 with respect to the bearing 102. The pinion 107 and the pulley 108 that are fixed to the shaft 104 are rotated counterclockwise in FIGS. 4 and 6.

The rotation of the pulley 108 causes the scrum belt 18 to move in the direction indicated by the arrow f in FIG. 8, thereby also causing the pulley 114 to rotate counterclockwise about the support pin 113.

Since the pinion 107 coupled to the sprocket 108 rotates counterclockwise in FIG. 4, the pinion 109 meshing with the pinion 107 is rotated clockwise, and the shaft 105 secured to the pinion 109 is rotated clockwise with respect to the bearing 103. The pulley 110 fixed to the shaft 105 is rotated clockwise in FIG. 8. When the pulley 110 is rotated clockwise, the scrum belt 19 is moved in the direction indicated by the arrow g in FIG. 6, thereby causing the pulley 120 to rotate clockwise about the support pin 119.

Thereafter, as shown in FIG. 1, a bag 2 filled up with a material is placed in an upstanding posture with its mouth 2*a* directed upwardly on the conveyor belt 133 of the belt conveyor 3 at a location near the auxiliary rollers 24. The belt conveyor 3 then conveys the bag 2 toward the sewing machine 134, maintaining the posture of the bag 2*a*. As the belt conveyor 3 advances, the mouth 2*a* of the bag 2 enters between the V-belts 4 and 5 and is gripped between the V-belts 4 and 5. The mouth 2*a* is further moved forward to enter between the V-belts 16 and 17 while gripping the same.

Figure 10:
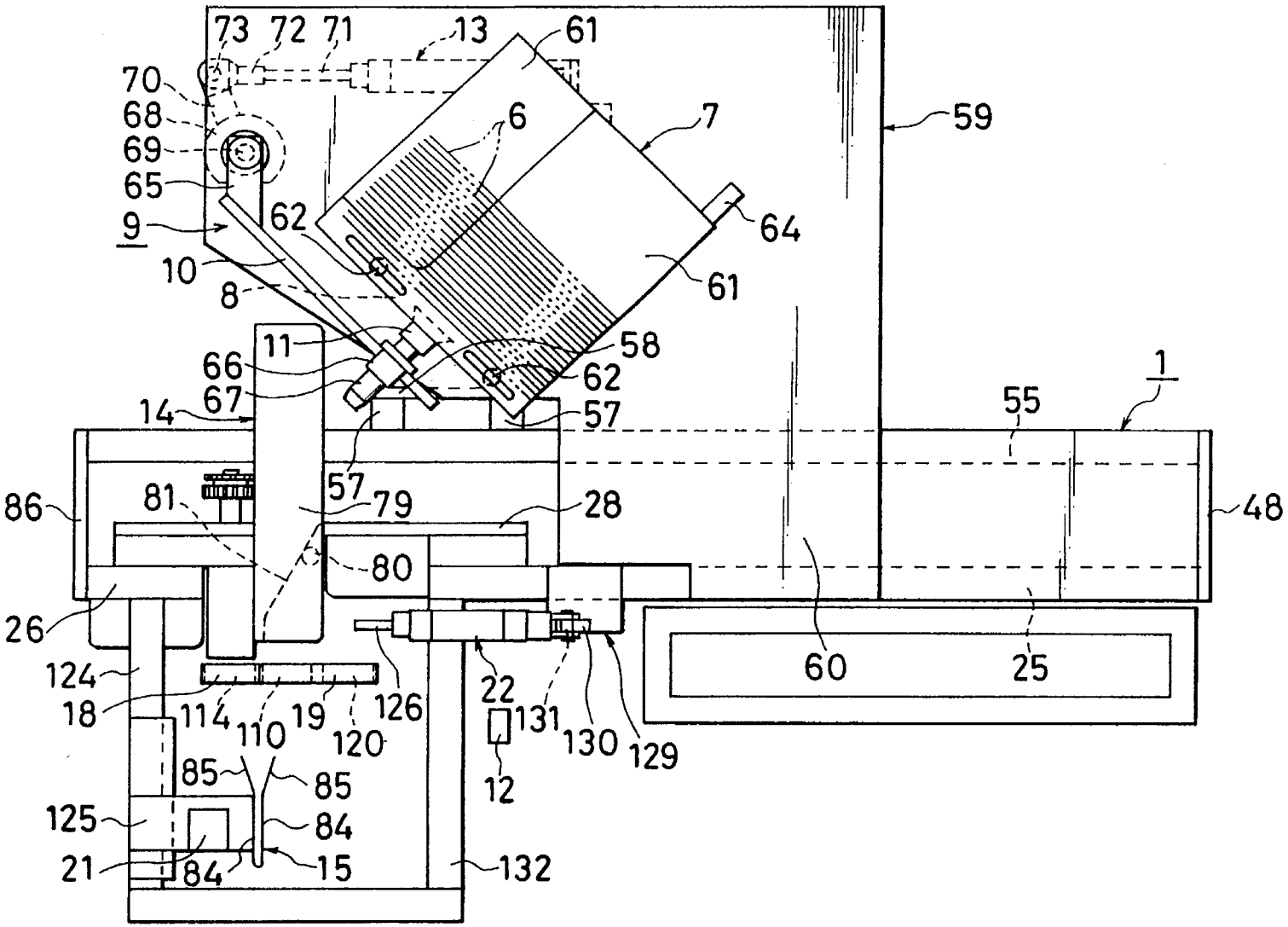
FIG. 10 is an enlarged front elevational view showing the manner in which a label is taken out from the label magazine by an arm of the label takeout mechanism.

When the bag 2 is conveyed to the photoelectric switch 12 by the belt conveyor 3, the photoelectric switch 12 detects the bag 2. In response to a detection signal from the photoelectric switch 12, the piston rod 71 of the air cylinder 13 is extended. The lever 70 is caused by the piston rod 71 to swing counterclockwise in FIG. 2, causing the support shaft 69 to turn counterclockwise with respect to the bearing 68. The counterclockwise angular movement of the support shaft 69 causes the arm 10 of the label takeout mechanism 9 to swing counterclockwise. As shown in FIG. 10, the suction cup 11 on the arm 10 moves through the recess 78 defined in the vertical wall 77 of the label guide 14 toward the access opening 8 of the label magazine 7. The suction cup 11 then enters the label magazine 7 through the access opening 8, and attracts the outermost one of the labels 6 stored in the label magazine 7.

Then, the piston rod 71 is retracted, causing the lever 70 to swing clockwise in FIG. 10. The support shaft 69 is rotated clockwise in FIG. 10 with respect to the bearing 68, thereby causing the arm 10 to swing clockwise in FIG. 10. The suction cup 11 with the label 6 attracted thereto is moved out of the label magazine 7 through the access opening 8 towards the recess 78 in the vertical wall 77 of the label guide 14. In this manner, the label takeout mechanism 9 removes one, at a time, of the labels 6 stored in the label magazine 7 from the access opening 8 thereof.

Subsequently, as shown in FIG. 9, the suction cup 11 is inactivated to allow the attracted label 6 to drop downwardly along the vertical wall 77 of the label guide 14. The label 6 is guided by the label guide 14 to pass through the gap 83 between the vertical wall 77 and the downwardly extending lip 82 of the guide plate 81, and then the label 6 is received by the label receiver 15. The label 6 is guided by the spreading guide portions 85 into the space between the side walls 84 of the label receiver 15. When the label 6 is received by the label receiver 15, the label 6 is positioned between the scrum belts 18 and 19.

Then, when the label 6 received by the label receiver 15 is detected by the photoelectric switch 15, the air cylinder 22 is actuated by a detection signal from the photoelectric switch, thereby causing the piston rod 128 to extend. When the piston rod 126 is extended, the arm 117 is turned clockwise in FIG. 4 about the shaft 105, thereby causing the scrum belt 19 to angularly move toward the scrum belt 18 until the scrum belt 19 is positioned close to and parallel to the scrum belt 18 as shown in FIG. 12.

Figure 12:
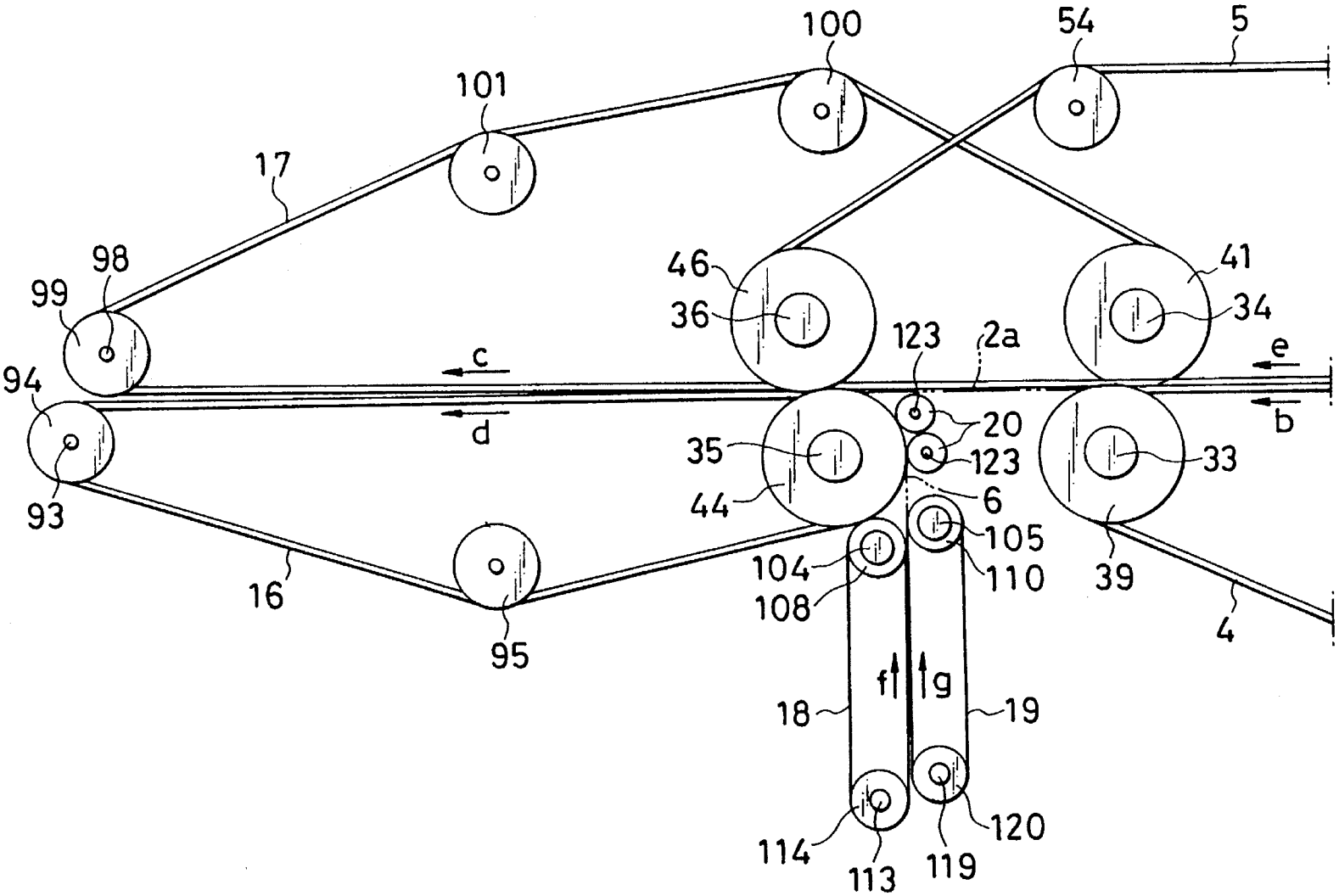
FIG. 12 is an enlarged plan view of a belt arrangement of the mechanisms shown in FIG. 11.

Then, as shown in FIG. 12, the scrum belts 18 and 19 cooperatively grip the label 6 in the label receiver 15 to transfer it between the pulley 44 and the resilient rollers 20. The resilient rollers 20 cooperate with the V-belt 16 in drawing the label 8 from the scrum belts 18 and 19 toward the mouth **2*a* of the bag 2. Thereafter, the label 6 and the mouth 2*a* of the bag 2 are held between the V-belts 16 and 17, and fed toward the sewing machine 134. When the label 6 and the mouth 2*a* of the bag 2 arrive at the sewing machine 134, the sewing machine 134** sews them together.

Figure 11:
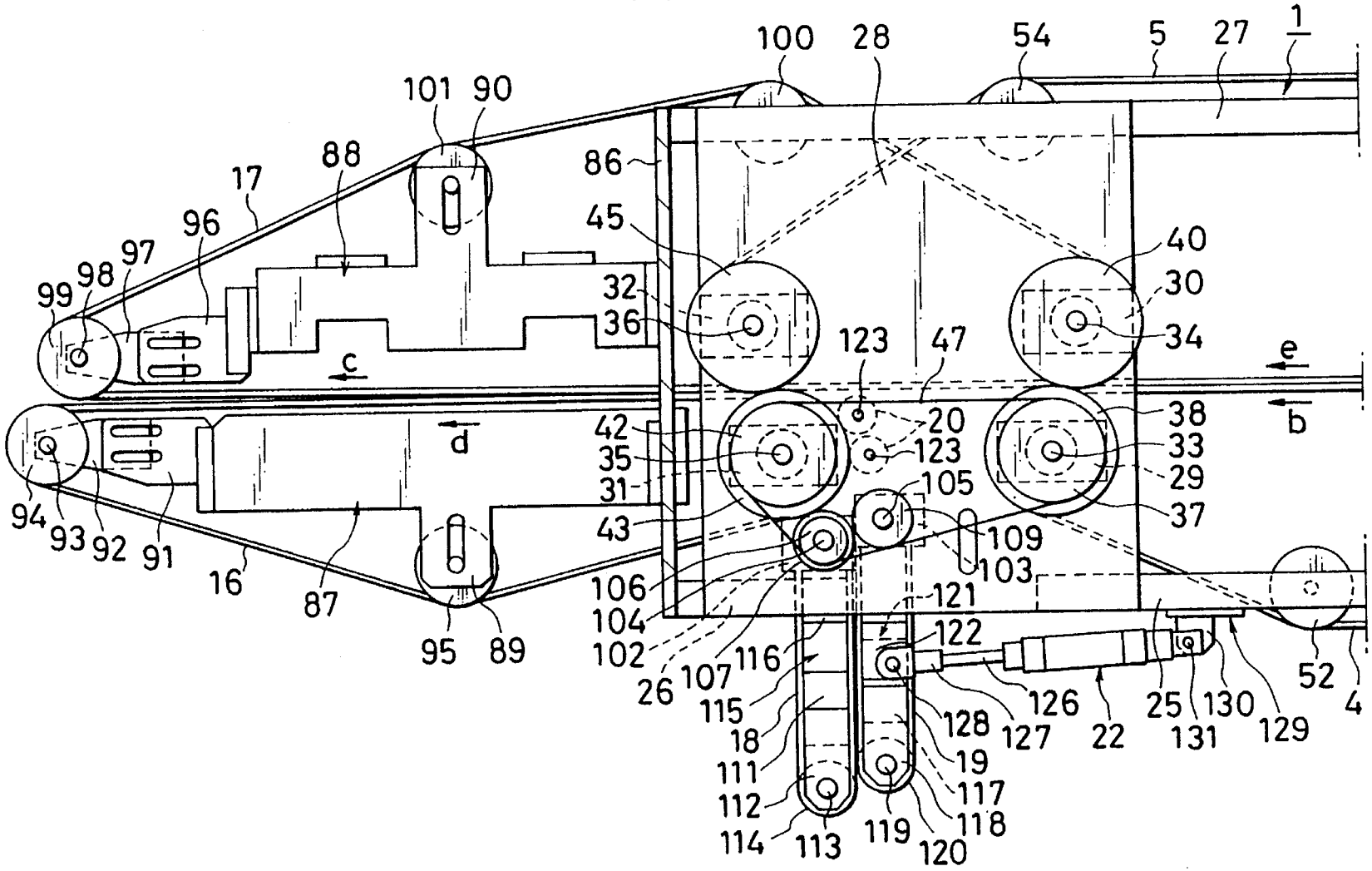
FIG. 11 is an enlarged plan view showing the manner in which a label is delivered by the label delivery mechanism.

Then, the piston rod 126 of the air cylinder 22 is retracted, causing the arm 117 to swing counterclockwise in FIG. 11 about shaft 105. As shown in FIGS. 4 and 6, upon the counterclockwise movement of the arm 117, the scrum belt 19 angularly moves laterally away from the scrum belt 18, and returns to its standby position spaced from the scrum belt 18.

When all the labels 6 stored in the label magazine 7 are used up, and the photoelectric switch 64 no longer detects any labels in the label magazine 7, the air cylinder 13 is not actuated even if the photoelectric switch 12 detects a bag 2 conveyed by the belt conveyor 3 and generates a detection signal.

As described above, with the arrangement of the present invention, since the suction cup 11 of the label remover 9 securely attracts by vacuum one label out of a number of labels stored in the label magazine 7, the label is prevented from being detached from the suction cup 11 while being carried toward the label guide 14. The label 6 released from the suction cup 11 drops along the label guide 14, and is then received by the label receiver 15, so that the label 6 quickly be placed between the first and-second scrum belts 18 and 19 which will cooperatively feed labels 6 successively toward the resilient rollers 20. Thus, according to the present invention, the label 6 can rapidly be supplied to the mouth **2*a*** of the bag without using any solid adhesive as is the case with the conventional label supplying apparatus, thereby contributing to simplifying the construction of the apparatus, as well as to reducing the manufacturing cost of the apparatus.

Although a certain preferred embodiment of the present invention has been shown and described in detail, it should be understood that various changes and modifications may be made therein without departing from the scope of the appended claims.

What is claimed is:

1. A label supplying apparatus for supplying a label to the mouth of a bag, comprising:

a bag conveying means for conveying a bag in an upstanding posture along a conveying path;

a table disposed upwardly of said bag conveying means;

a first guide-and-feed means disposed between said bag conveying means and said table, for guiding and feeding the mouth of the bag along the conveying path of said conveying means while gripping the mouth of the bag;

a label magazine for storing a plurality of labels, said label magazine being disposed upwardly of said table and having an access opening;

a label takeout mechanism disposed near said access opening of said label magazine and having a swing arm and a suction cup mounted on a distal end of said swing arm for attracting and releasing one, at a time, of the labels stored in said label magazine;

a bag detecting means disposed downwardly of said table, for detecting the bag conveyed by said bag conveying means;

a first actuator means responsive to a detection signal from said bag detecting means, for angularly moving said swing arm of the label takeout mechanism;

a label guide for downwardly guiding the label released from said suction cup of the label takeout mechanism;

a label receiving means disposed downwardly of said label guide, for receiving the label guided downwardly by said label guide;

a label detecting means for detecting the label received by said label receiving means;

a first and a second label delivery means disposed between said label guide and said label receiving means and movable toward and away from each other, for gripping and transferring a label in a direction substantially perpendicular to said conveying path;

a second actuator means responsive to a detection signal from said label detecting means, for relatively moving said first and second label delivery means toward and away from each other;

a second guide-and-feed means disposed upwardly of said bag conveying means in series with said first guide-and-feed means, for guiding and feeding the mouth of the bag guided and fed by said first guide-and-feed means while gripping the mouth of the bag and a label together; and a label drawing means disposed near said first and second label delivery means, for drawing the label delivered by said first and second label delivery means toward the mouth of the bag guided and fed by said first guide-and-feed means, in cooperation with said second guide-and-feed means.

2. A label supplying apparatus according to claim 1, wherein said first guide-and-feed means is mechanically coupled to said second guide-and-feed means, and operable in synchronism with said second guide-and-feed means.

3. A label supplying apparatus according to claim 2, further comprising a transmitting mechanism including sprockets, a chain trained around said sprockets, and gears fixed to said sprockets, said first guide-and-feed means being operatively coupled to said second guide-and-feed means through sprockets, chains and gears by said transmitting.

4. A label supplying apparatus according to claim 1, wherein said first guide-and-feed means is disposed partially overlapping with said second guide-and-feed means, for successively gripping and feeding the mouth of the bag therethrough.

5. A label supplying apparatus according to claim 1, wherein said first label delivery means comprises:

a first arm;

a pair of first pulleys rotatably mounted respectively on opposite ends of said first arm; and a first belt wound around said first pulleys, and wherein said second label delivery means comprises:

a second arm disposed swingably about a proximal end thereof;

a pair of second pulleys rotatably mounted respectively on opposite ends of said second arm; and a second belt wound around said second pulleys for gripping the label between itself and said first belt and delivering the label toward said label drawing means.

6. A label supplying apparatus according to claim 1, further comprising a vacuum generator connected to said suction cup of the label takeout mechanism and actuatable for causing said suction cup to selectively attract and release one, at a time, of the labels stored in said label magazine.

7. A label supplying apparatus according to claim 1, further comprising a sewing machine for sewing together the mouth of the bag and the label guided and fed by said second guide-and-feed means.

* * * * *